US008296134B2

(12) United States Patent
Teo et al.

(10) Patent No.: US 8,296,134 B2
(45) Date of Patent: Oct. 23, 2012

(54) AUDIO ENCODING APPARATUS AND SPECTRUM MODIFYING METHOD

(75) Inventors: Chun Woei Teo, Singapore (SG); Sua Hong Neo, Singapore (SG); Koji Yoshida, Kanagawa (JP); Michiyo Goto, Tokyo (JP)

(73) Assignee: Panasonic Corporation, Osaka (JP)

( * ) Notice: Subject to any disclaimer, the term of this patent is extended or adjusted under 35 U.S.C. 154(b) by 883 days.

(21) Appl. No.: 11/914,296

(22) PCT Filed: May 11, 2006

(86) PCT No.: PCT/JP2006/309453

§ 371 (c)(1),
(2), (4) Date: Nov. 13, 2007

(87) PCT Pub. No.: WO2006/121101

PCT Pub. Date: Nov. 16, 2006

(65) Prior Publication Data

US 2008/0177533 A1 Jul. 24, 2008

(30) Foreign Application Priority Data

May 13, 2005 (JP) ..... 2005-141343

(51) Int. Cl.
*G10L 19/14* (2006.01)

(52) U.S. Cl. ..... 704/225; 704/221; 704/219; 704/208; 704/202; 84/726; 84/649; 375/240.01; 341/50

(58) Field of Classification Search ..... 704/202, 704/208, 219, 221; 341/50; 84/726, 649; 375/240.01

See application file for complete search history.

(56) References Cited

U.S. PATENT DOCUMENTS 4,351,216 A * 9/1982 Hamm ..... 84/726
5,600,754 A * 2/1997 Gardner et al. ..... 704/221
5,663,517 A * 9/1997 Oppenheim ..... 84/649
5,680,508 A * 10/1997 Liu ..... 704/227
5,684,920 A 11/1997 Iwakami et al.
5,737,716 A * 4/1998 Bergstrom et al. ..... 704/202

(Continued)

FOREIGN PATENT DOCUMENTS

EP 0673014 A 9/1995

(Continued)

OTHER PUBLICATIONS

Faller et al., "Binaural cue coding—Part II: Schemes and applications," IEEE Transactions on Speech and Audio Processing, vol. 11, Issue 6, Nov. 2003, pp. 520-531.

(Continued)

*Primary Examiner* — Michael Colucci
(74) *Attorney, Agent, or Firm* — Greenblum & Bernstein P.L.C.

(57) ABSTRACT

A spectrum modifying method and the like wherein the efficiencies of the signal estimation and prediction can be improved and the spectrum can be more efficiently encoded. According to this method, the pitch period is calculated from an original signal, which serves as a reference signal, and then a basic pitch frequency ($f_0$) is calculated. Thereafter, the spectrum of a target signal, which is a target of spectrum modification, is divided into a plurality of partitions. It is specified here that the width of each partition be the basic pitch frequency. Then, the spectra of bands are interleaved such that a plurality of peaks having similar amplitudes are unified into a group. The basic pitch frequency is used as an interleave pitch.

9 Claims, 11 Drawing Sheets

U.S. PATENT DOCUMENTS

| | | | | |
|---|---|---|---|---|
| 6,138,101 | A * | 10/2000 | Fujii | 704/500 |
| 6,345,246 | B1 * | 2/2002 | Moriya et al. | 704/219 |
| 6,353,807 | B1 * | 3/2002 | Tsutsui et al. | 704/230 |
| 6,377,916 | B1 * | 4/2002 | Hardwick | 704/208 |
| 6,658,382 | B1 * | 12/2003 | Iwakami et al. | 704/224 |
| 6,901,362 | B1 * | 5/2005 | Jiang et al. | 704/214 |
| 7,092,881 | B1 * | 8/2006 | Aguilar et al. | 704/233 |
| 7,139,702 | B2 * | 11/2006 | Tsushima et al. | 704/222 |
| 7,246,065 | B2 * | 7/2007 | Tanaka et al. | 704/500 |
| 7,643,552 | B2 * | 1/2010 | Saishu et al. | 375/240.01 |
| 2005/0149322 | A1 * | 7/2005 | Bruhn et al. | 704/211 |
| 2005/0231396 | A1 * | 10/2005 | Dunn | 341/50 |
| 2007/0233470 | A1 | 10/2007 | Goto et al. | |

FOREIGN PATENT DOCUMENTS

| | | |
|---|---|---|
| EP | 1047047 A | 10/2000 |
| JP | 7104793 | 4/1995 |
| JP | 2000-338998 | 12/2000 |
| WO | 03/090208 | 10/2003 |

OTHER PUBLICATIONS

Faller et al., "Binaural cue coding: A novel and efficient representation of spatial audio," Proceedings of ICASSP, Orlando, Florida, Oct. 2002, pp. 11-1841 to 11-1844.

U.S. Appl. No. 11/573,760 to Goto et al., filed Feb. 15, 2007.

U.S. Appl. No. 11/815,916 to Teo et al., filed Aug. 9, 2007.

U.S. Appl. No. 11/574,783 to Yoshida, filed Mar. 6, 2007.

* cited by examiner

AUDIO ENCODING APPARATUS AND SPECTRUM MODIFYING METHOD

TECHNICAL FIELD

The present invention relates to a speech coding apparatus and a spectrum modification method.

BACKGROUND ART

The speech codec that encodes a monaural speech signal is the norm now. Such a monaural codec is commonly used in the communication equipment such as a mobile phone and teleconferencing equipment where the signal usually comes from a single source, for example, human speech.

In the past, due to the limitation of the transmission bandwidth and the processing speed of DSPs, such a monaural signal is used. However, the technology progresses and bandwidth improves, and this constraint is slowly becoming less important. Quality of speech on the other hand becomes a more important factor to be considered. One drawback of the monaural speech is that the monaural speech does not provide spatial information such as sound imaging or position of the speakers and the like. Therefore, a factor to be considered is to achieve good stereo speech quality at the lowest possible bit rate so as to realize better sound.

One method of encoding a stereo speech signal includes utilizing signal prediction or estimation technique. That is, one channel is encoded using a prior known audio coding technique and the other channel is predicted or estimated from the encoded channel using some side information of the other channel which is analyzed and extracted.

Such method can be found in Patent Document 1 as part of the binaural cue coding system (for example, see Non-Patent Document 1) which is applied to the computation of the inter-channel level difference (ILD) for the purpose of adjusting the level of one channel with respect to a reference channel.

Frequently, the predicted or estimated signal is not as accurate compared to the original signal. Therefore, the predicted or estimated signal needs to be enhanced so that it can be as similar to the original as possible.

An audio signal and speech signal are commonly processed in the frequency domain. This frequency domain data is generally referred to as the "spectral coefficients in the transformed domain." Therefore, such a prediction and estimation method can be done in the frequency domain. For example, the left and right channel spectrum data can be estimated by extracting some of the side information and applying the result to the monaural channel (see Patent Document 1). Other variations include estimating one channel from the other channel as in the left channel which can be estimated from the right channel.

One area in audio and speech processing where such enhancement is applied is the spectrum energy estimation. It can also be referred to as "spectrum energy prediction" or "scaling." In a typical spectrum energy estimation computation, the time domain signal is transformed to a frequency domain signal. This frequency domain signal is usually partitioned into frequency bands according to critical bands. This is done for both channels, that is, the reference channel and the channel which is to be estimated. For frequency bands of both channels, the energy is computed and scale factors are calculated using the energy ratios of both channels. These scale factors are transmitted to the receiving apparatus where a reference signal is scaled using these scale factors to retrieve the estimated signal in the transformed domain for frequency bands. Then, an inverse frequency transform is applied to obtain the equivalent time domain signal of the estimated transformed domain spectrum data.

Patent Document 1: International publication No. 03/090208 pamphlet

Non-Patent Document 1: C. Faller and F. Baumgarte, "Binaural cue coding: A novel and efficient representation of spatial audio", Proc. ICASSP, Orlando, Fla., October 2002.

DISCLOSURE OF INVENTION

Problems to be Solved by the Invention

FIG. 1 shows an example of a spectrum (excitation spectrum) of an excitation signal. The frequency spectrum shows the excitation signal of a periodic and stationary signal exhibiting periodic peaks. Furthermore, FIG. 2 shows an example of partitioning using critical bands.

In the prior art method, the frequency domain spectral coefficients are divided into critical bands and are used to compute the energy and scale factor as illustrated in FIG. 2. Although this method is commonly used in processing the non-excitation signal, this method is not so suitable for an excitation signal due to the repetitive pattern in the spectrum of the excitation signal. The non-excitation signal here means a signal which is used for signal processing such as LPC analysis which produces the excitation signal.

In this way, simply dividing the excitation signal spectrum into critical bands cannot compute accurate scale factors which represent rises and falls of peaks in the excitation spectrum due to the unequal bandwidth of bands for critical band partitioning as illustrated in FIG. 2.

Therefore, it is an object of the present invention to provide a speech coding apparatus and a spectrum modifying method which make it possible to improve the efficiency of signal estimation and prediction and more efficiently represent a spectrum.

Means for Solving the Problem

In order to solve the above problems, the present invention computes a pitch period of a portion of a speech signal having periodicity. The pitch period is used to derive the fundamental pitch frequency or the iterative pattern (harmonic structure) of a speech signal. The regular interval or periodic pattern of the spectrum can be utilized to compute the scale factor by grouping the peaks (spectral coefficient) which are similar in amplitude into one group and generating the groups together by the means of interleaving processing. The spectrum of the excitation signal is rearranged by interleaving the spectrum using the fundamental pitch frequency as the interleaving interval.

In this way, the spectral coefficients which are similar in amplitude are grouped together, so that it is possible to improve the quantization efficiency of the scale factor used in adjusting the spectrum of the target signal to the correct amplitude level.

Furthermore, in order to solve the above problems, the present invention selects whether interleaving is necessary or not. The decision criterion is based on the type of signal being processed. Segments of a speech signal which are periodic exhibit iterative patterns in the spectrum. In such a case, the spectrum is interleaved using the fundamental pitch frequency as the interleaving unit (interleaving interval). On the other hand, segments of a speech signal which are non-periodic speech signal do not have specific pattern in the spectrum waveform. Therefore, non-interleave spectrum modification is performed.

As a result, a flexible system which selects the appropriate spectrum modification method to correspond to different types of signals, and the total coding efficiency improves.

Advantageous Effect of the Invention

The present invention makes it possible to improve the efficiency of signal estimation and prediction and more efficiently represent a spectrum.

BEST MODE FOR CARRYING OUT THE INVENTION

The speech coding apparatus according to the present invention modifies an inputted spectrum and encodes the modified spectrum. First, in the coding apparatus, the target excitation signal to be modified is transformed to spectrum components in the frequency domain. This target signal is normally a signal which is dissimilar to the original signal. The target signal may be a predicted or estimated version of the original excitation signal.

The original signal will be used as the reference signal for spectral modification processing. It is decided whether or not the reference signal is periodic. When the reference signal is decided to be periodic, pitch period T is computed. Fundamental pitch frequency $f_0$ of the reference signal is computed from this pitch period T.

Figure 3:
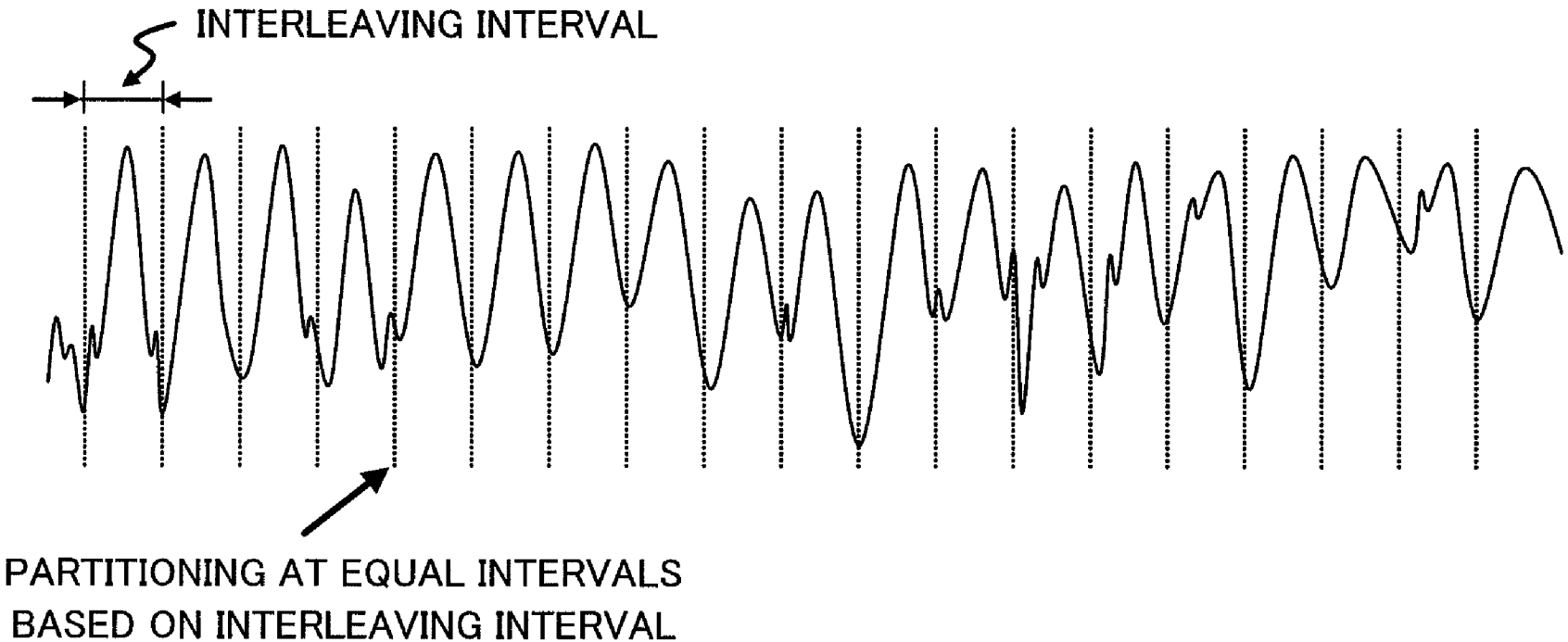
FIG. 3 shows an example of a spectrum subjected to band partitioning at the equal intervals according to the present invention.
Figure 4:
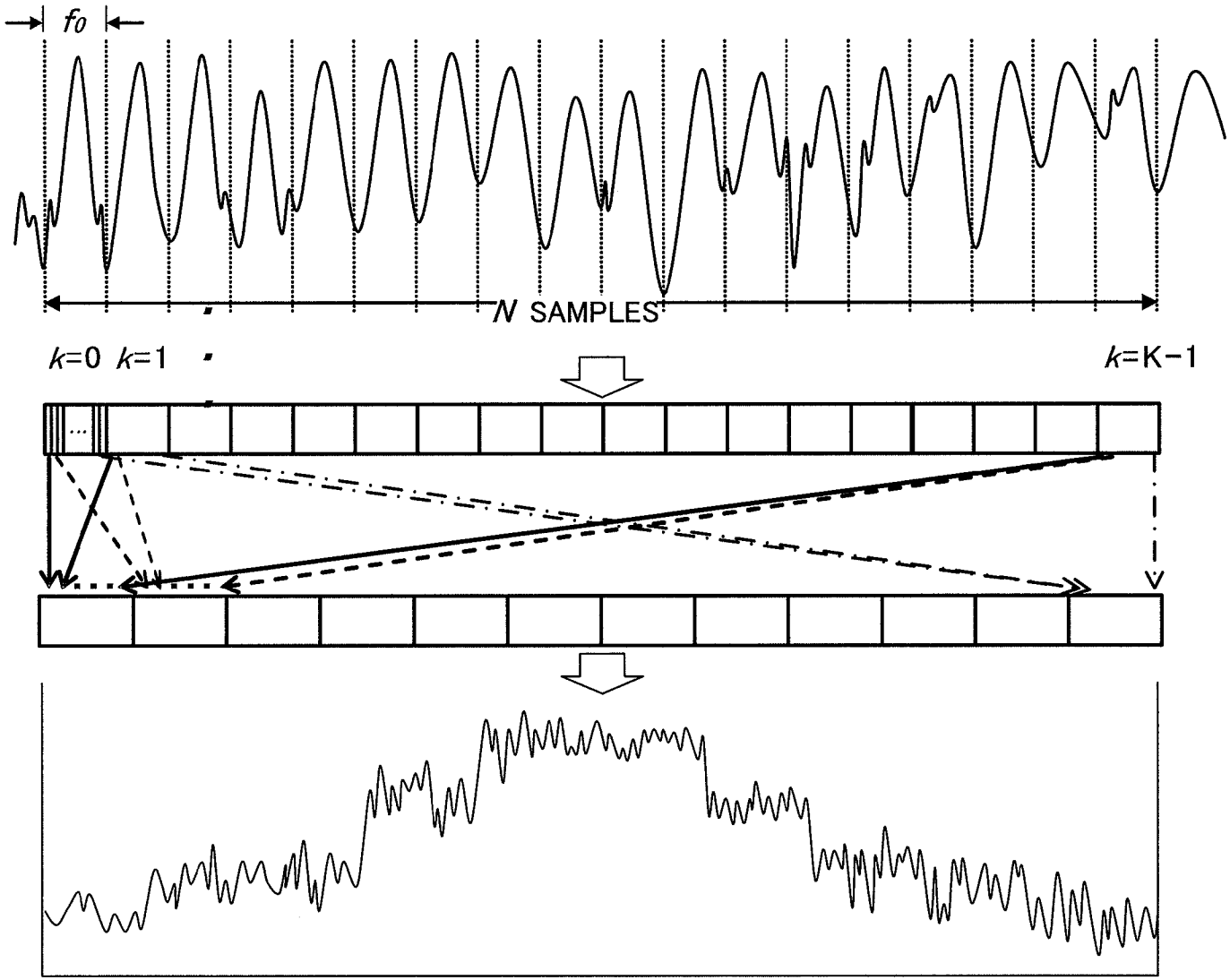
FIG. 4 shows an overview of interleaving processing according to the present invention.

Spectrum interleaving processing is performed on a frame which is decided to be periodic. A flag (hereinafter, referred to as an "interleave flag") is used to indicate a target of spectrum interleaving processing. First, the target signal spectrums and the reference signal spectrums are divided into a number of partitions. The width of each partition is equivalent to the width of fundamental pitch frequency $f_0$. FIG. 3 shows an example of a spectrum subjected to band partitioning at the equal intervals according to the present invention. The spectrum in each band is interleaved using fundamental pitch frequency $f_0$ as the interleaving interval. FIG. 4 shows an overview of the above interleaving processing.

The interleaved spectrum is further divided into several bands. The energy of each band is then computed. For each band, the energy of the target channel is compared to the energy of the reference channel. The difference or ratio between the energy of these two channels are computed and quantized as a form of scale factor. This scale factor is transmitted together with the pitch period and the interleave flag to the decoding apparatus for spectral modification processing.

On the other hand, at the decoder side, the target signal synthesized by the main decoder is modified using the parameters transmitted from the coding apparatus. The target signal is transformed into the frequency domain. The spectral coefficients are interleaved using the fundamental pitch frequency as the interleaving interval if the interleave flag is set to be active. This fundamental pitch frequency is computed from the pitch period transmitted from the coding apparatus. The interleaved spectral coefficients are divided into the same number of bands as in the coding apparatus and for each band, the amplitude of the spectral coefficients are adjusted using scale factors such that the spectrum will be as close to the spectrum of the reference signal. Then, the adjusted spectral coefficients are deinterleaved to rearrange the interleaved spectral coefficients back to the original sequence. Inverse frequency transform is performed on the adjusted deinterleaved spectrum to obtain the excitation signal in the time domain. For the above processing, if the signal is determined as non-periodic, the interleaving processing is skipped while the other processing continues as described.

Hereinafter, embodiments of the present invention will be described with reference to the attached drawings. Here, components having similar functions will be basically assigned the same reference numerals and when there are a plurality of such components, "a" and "b" will be appended to their reference numerals to make a distinction.

(Embodiment 1)

Figure 5:
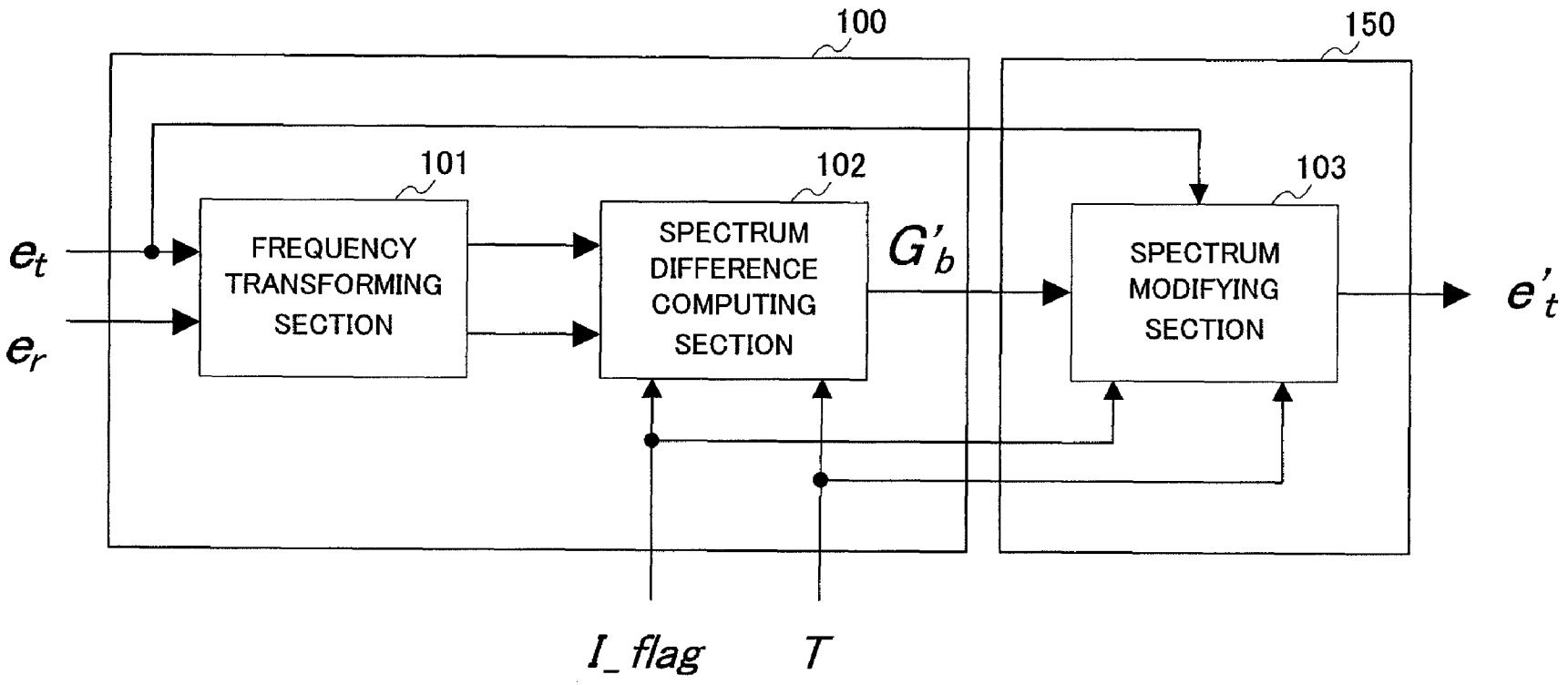
FIG. 5 is a block diagram showing the basic configurations of the speech coding apparatus and the speech decoding apparatus according to Embodiment 1.

FIG. 5 is a block diagram showing the basic configurations of coding apparatus 100 and decoding apparatus 150 according to this embodiment.

In coding apparatus 100, frequency transforming section 101 transforms reference signal $e_r$ and target signal $e_t$ to frequency domain signals. Target signal $e_t$ resembles reference signal $e_r$. Furthermore, reference signal $e_r$ can be obtained by inverse filtering input signal s with the LPC coefficient and target signal $e_t$ is obtained as the result of the excitation coding processing.

In spectrum difference computing section 102, the spectral coefficients obtained after the frequency transform are processed to compute the spectrum difference between the reference and the target signal in the frequency domain. The computation involves a series of processings such as interleaving the spectral coefficients, partitioning the coefficients into a plurality of bands, computing the difference of the bands between the reference channel and the target channel and quantizing these differences $G'_b$ to be transmitted to the decoding apparatus. Although interleaving is an important part of the spectrum difference computation, not all frame of signal needs to be interleaved. Whether interleaving is necessary or not is indicated by interleave flag I_flag, and whether the flag is active or not depends on the type of a signal being processed at the current frame. If a particular frame needs to be interleaved, the interleaving interval which is derived from pitch period T of the current speech frame is used. These processings are performed at the coding apparatus of the speech codec.

At decoding apparatus 150, after obtaining target signal $e_t$, quantized information $G'_b$ together with the other information such as interleaving flag I_flag and pitch period T are used in spectrum modifying section 103 to modify the spectrum of the target signal such that its spectrum by these parameters are close to the spectrum of the reference signal.

Figure 6:
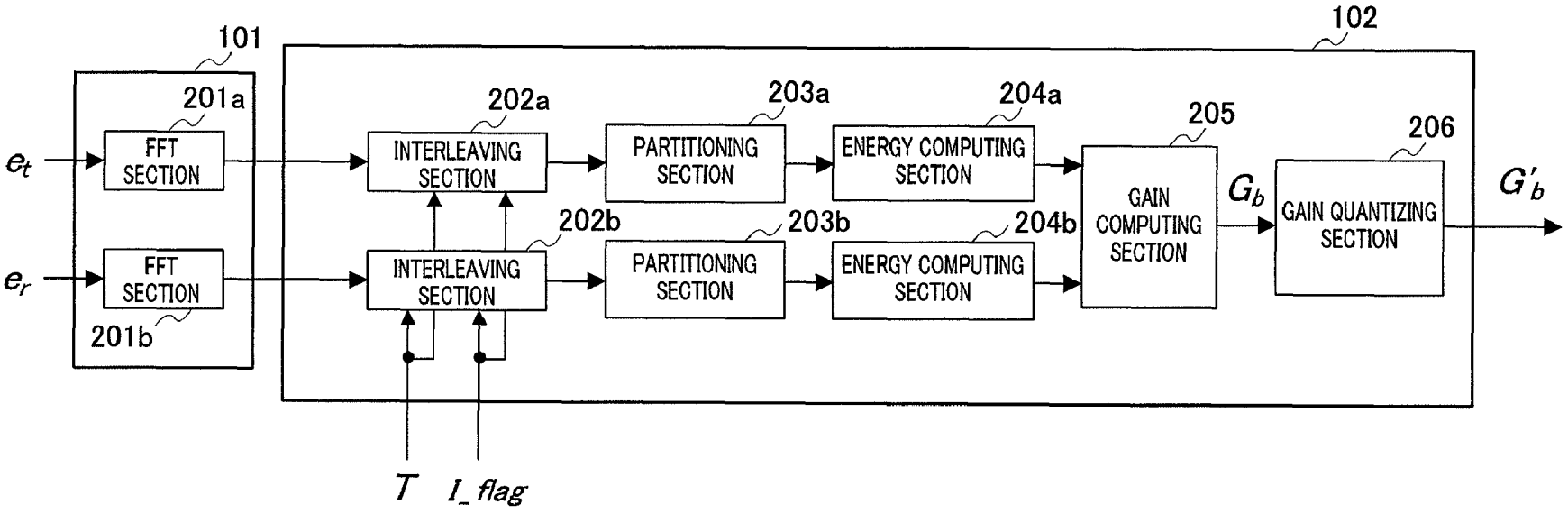
FIG. 6 is a block diagram showing the main configurations inside the frequency transforming section and the spectrum difference computing section according to Embodiment 1.

FIG. 6 is a block diagram showing the main configurations inside above frequency transforming section 101 and spectrum difference computing section 102.

Figure 1:
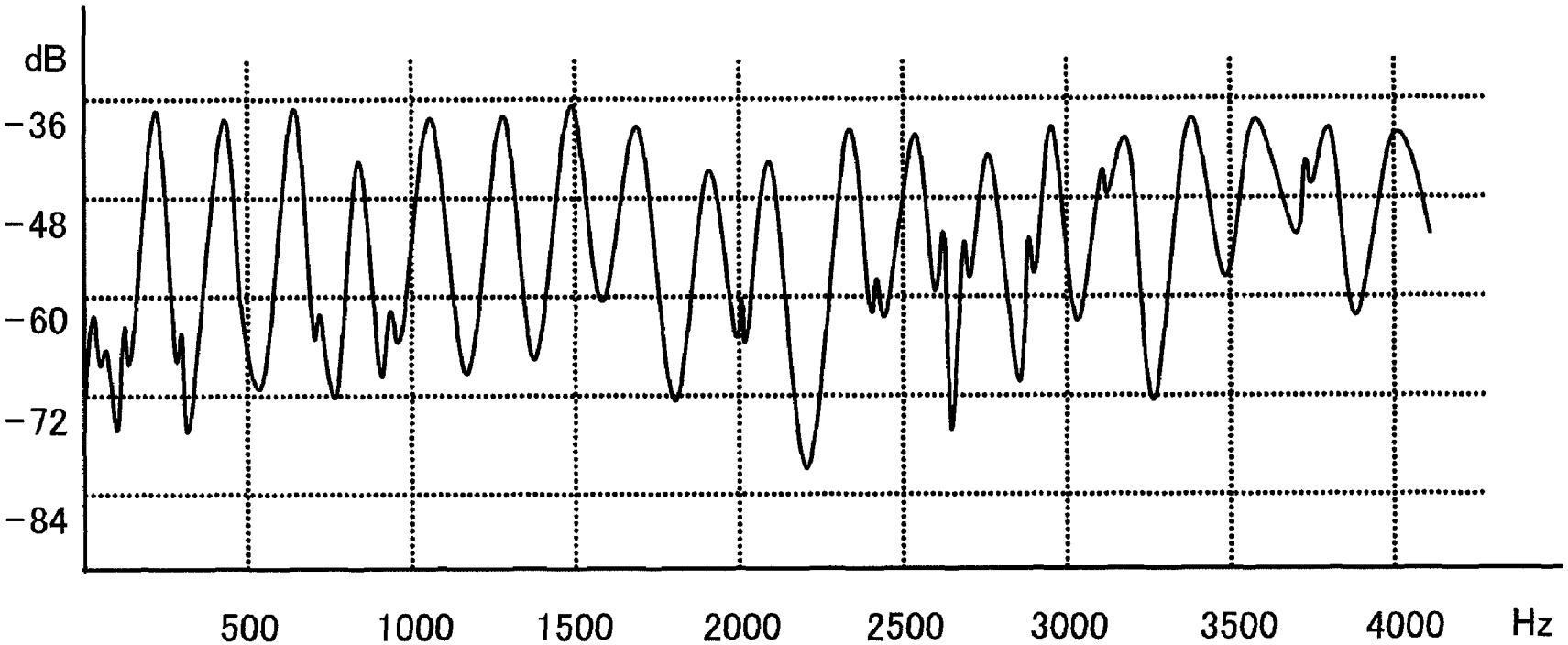
FIG. 1 shows an example of a spectrum of an excitation signal.
Figure 2:
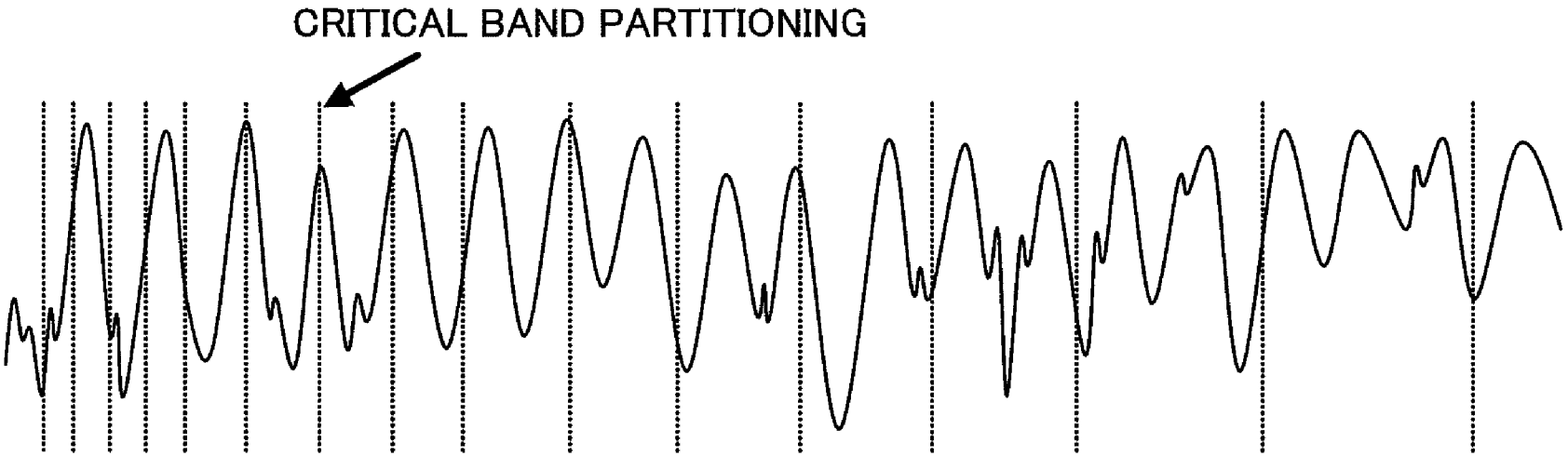
FIG. 2 shows an example of partitioning using critical bands.

Reference signal $e_r$ and target signal $e_t$ to be modified are transformed to the frequency domain in FFT section 201 using a transform method such as FFT. A decision is made to determine whether a particular frame of a signal is suitable to be interleaved using flag I_flag as an indication. Prior to the interleaving processing in interleaving section 202, pitch detection is performed to determine whether the current speech frame is a periodic and stationary signal. If the frame to be processed is found to be a periodic and stationary signal, the interleave flag is set to be active. For a periodic and stationary signal, the excitation usually produces a periodic pattern in the spectrum waveform with a distinct peak at a certain interval (see FIG. 1). This interval is determined by pitch period T of the signal or fundamental pitch frequency $f_0$ in the frequency domain.

If the interleave flag is set to be active, interleaving section 202 performs the sample interleaving on the transformed spectral coefficient for both the reference signal and target signal. A region within the bandwidth is selected in advance for the sample interleaving. Usually, the lower frequency region up to 3 kHz or 4 kHz produces a more distinct peak in the spectrum waveform. Therefore, the low frequency region is often selected as the interleaving region. For example, when referring to FIG. 4 once again, a spectrum of N samples is selected as the low frequency region to be interleaved. Fundamental pitch frequency $f_0$ of the current frame is used as the interleaving interval such that similar energy coefficients are grouped together after the interleaving processing. Then, N samples are divided into K partitions and interleaved. This interleaving processing is carried out by computing the spectral coefficient of each band according to following equation 1. Here, J represents the number of samples of each band, that is, the size of each partition.

$$\text{interleaved_coeff}_{(k+j\times K)} = coefficient_{(k\times J+j)} \quad \text{(Equation 1)}$$
$$\begin{cases} \text{for } k = 0, 1, \ldots, K-1 \\ \text{for } j = 0, 1, \ldots, J-1 \end{cases}$$

The interleaving processing according to the present invention does not use a fixed value for the interleaving interval for all input speech frames. This interleaving interval is adjusted adaptively by computing fundamental pitch frequency $f_0$ of the reference signal. Fundamental pitch frequency $f_0$ is derived directly from pitch period T of the reference signal.

Figure 7:
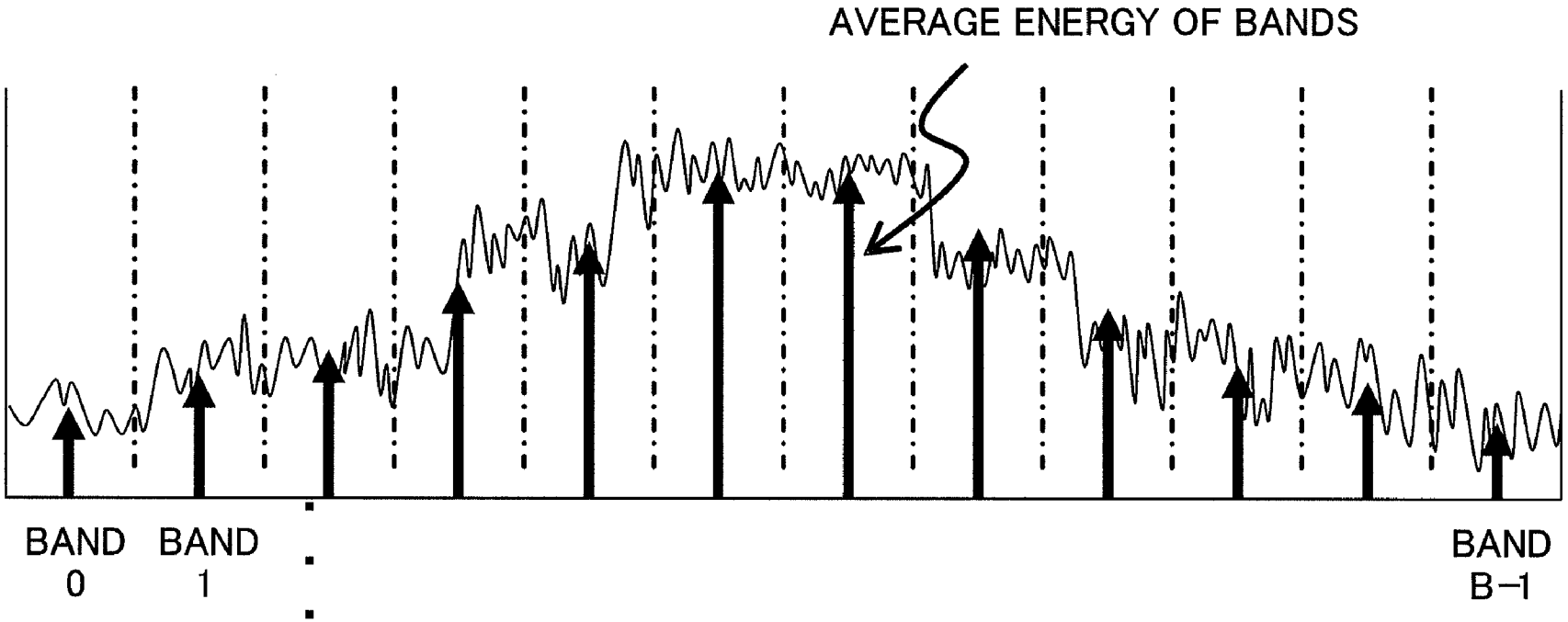
FIG. 7 shows an example of band division.

After interleaving the spectral coefficients, partitioning section 203 divides the interleaved coefficients in the N samples region into B bands as illustrated in FIG. 7, such that the bands each has an equal integer number of coefficients. The number of bands can be set to one arbitrary number such as 8, 10 or 12. The number of bands is preferably set to such a number that spectral coefficients in each band extracted from the same position of each pitch harmonic are similar in amplitude. That is, the number of bands is set so as to be equal to or a multiple of the number of partitions in the interleaving processing, that is, so as to obtain B=K bands or B=LK bands (where L is an integer). The sample of j=0 in each pitch period is coincident with the initial sample of each interleaved bands and the sample of j=J−1 in each pitch period is coincident with the last samples of each interleaved band.

In cases where the number of bands is not multiples of K bands, the number of coefficients may not be equally distributed. In such a case, partitioning section 203 allocates equally divisible samples according to following equation 2a and allocates the remaining samples to the last band (b=B−1) according to following equation 2b.

$$\text{numCoef}_b = \text{integer}(N/B) \text{ for } b=0, 1, \ldots, B-2 \quad \text{(Equation 2a)}$$

$$\text{numCoef}_b = N - \{\text{integer}(N/B)\times(B-1)\} \text{ for } b=B-1 \quad \text{(Equation 2b)}$$

If interleaving is not used for a particular frame, the non-interleaved coefficients are allocated to the bands using the same way of the band allocation of the above remaining samples as explained above and be partitioned.

Energy computing section 204 computes the energy of band b according to following equation 3.

$$energy_b = \frac{1}{numCoef_b} \sum_{i=0}^{numCoef_b - 1} \text{interleaved_coeff}_i^2 \quad \text{(Equation 3)}$$
$$\text{for } b = 0, 1, \ldots, B-1$$

The above energy computation is done for each band of both the reference signal and the target signal to produce $\text{energy_ref}_b$ of the reference signal energy and $\text{energy_tgt}_b$ of the target signal energy For the region which is not included in the N samples, no interleaving is performed. The samples in the non-interleaved region are also partitioned into a number of bands such as 2 to 8 bands using equation 2a and 2b and the energy of these non-interleaved bands is computed using equation 3.

The energy data of the reference signal and the target signal for both the interleaved and non-interleaved regions are used to compute gain $G_b$ in gain computing section 205. This gain $G_b$ is the gain to scale and modify the target signal spectrum at the decoding apparatus. Gain $G_b$ is computed according to following equation 4.

$$G_b = \sqrt{\frac{\text{energy_ref}_b}{\text{energy_tgt}_b}} \text{ for } b = 0, 1, \ldots, B_T - 1 \quad \text{(Equation 4)}$$

Here, $B_T$ is the total number of bands in both interleaved and non-interleave regions.

Gain $G_b$ is then quantized in gain quantizing section 206 to obtain quantized gain $G'_b$ using scalar quantization or vector quantization commonly known in the field of quantization. Quantized gain $G'_b$ is transmitted to decoding apparatus 150 together with pitch period T and interleave flag I_flag to modify the spectrum of the signal at the decoding apparatus.

The processing at decoding apparatus 150 is the reverse processing where the difference of the target signal compared to the reference signal is computed. That is, at the decoding apparatus, these differences are applied to the target signal such that the modified spectrum can be as close to the reference signal as possible.

Figure 8:
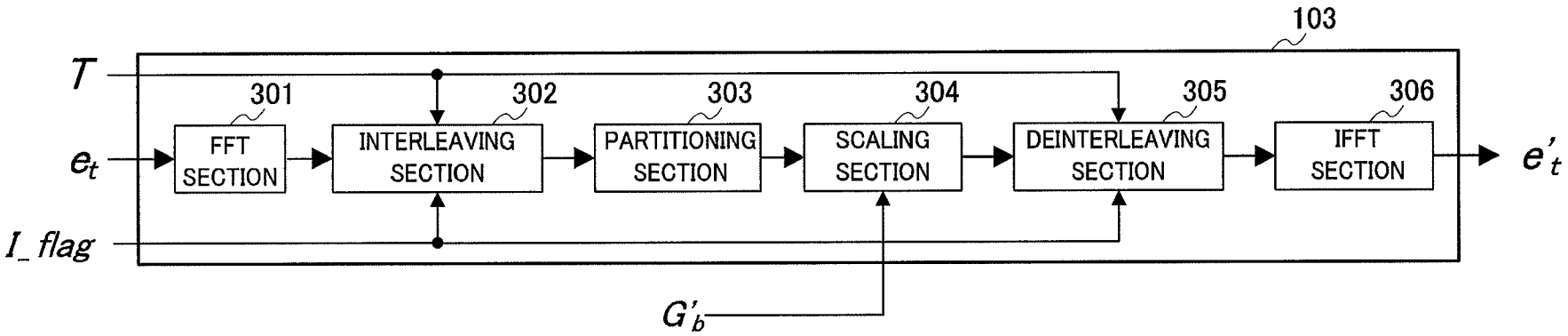
FIG. 8 shows inside the spectrum modifying section according to Embodiment 1.

FIG. 8 shows inside spectrum modifying section 103 provided in above decoding apparatus 150.

It is assumed that at this stage, same target signal $e_t$ as in coding apparatus 100 that needs to be modified is already synthesized at decoding apparatus 150 so that spectrum modification can be carried out. Furthermore, quantized gain $G'_b$, pitch period T and interleave flag I_flag are also decoded from the bit stream so as to proceed with the processing in spectrum modifying section 103.

Target signal $e_t$ is transformed to the frequency domain in FFT section 301 using the same transform processing used at coding apparatus 100.

If interleave flag I_flag is set to be active, then the spectral coefficients are interleaved according to equation 1 in interleaving section 302 using fundamental pitch frequency $f_0$ which is derived from pitch period T as the interleaving interval. This interleave flag I_flag indicates whether the current frame of signal needs to be interleaved.

Partitioning section 303 divides the coefficients into the same number of bands used in coding apparatus 100. If interleaving is used, then the interleaved coefficients are partitioned, otherwise the non-interleaved coefficients are partitioned.

Scaling section 304 computes the spectral coefficient of each band after the scaling according to following equation 5 using quantization gain $G'_b$.

$$\text{scaled_coeff}_{b,i} = coeff_{b,i} \times G'_b \quad \text{(Equation 5)}$$

$$\begin{cases} \text{for } b = 0, 1, \ldots, B_T - 1 \\ \text{for } i = 0, 1, \ldots, \text{band}(b) - 1 \end{cases}$$

Here, band(b) is the number of coefficients in the band indexed by b. Above equation 5 adjusts the coefficient value such that the energy of each band is comparable to the energy compared to the reference signal and the spectrum of the signal is modified.

If the coefficients are interleaved in interleaving section 302, then deinterleaving section 305 is used to rearrange the interleaved coefficients back to the original sequence before interleaving. On the other hand, if no interleaving is performed in interleaving section 302, then deinterleaving section 305 does not carry out deinterleaving processing. The adjusted spectral coefficients are then transformed back to a time domain signal by inverse frequency transform such as inverse FFT in IFFT section 306. This time domain signal is predicted or estimated excitation signal $e'_t$ whose spectrum is modified such that the spectrum is similar to the spectrum of reference signal $e_r$.

In this way, this embodiment improves the coding efficiency of the speech coding apparatus by using the periodic pattern (iterative pattern) in the frequency spectrum, modifying the signal spectrum using the interleaving processing and grouping the similar spectral coefficients.

Further, this embodiment helps to improve the quantization efficiency of the scale factor which is used to adjust the spectrum of the target signal to the correct amplitude level. The interleaving flag offers a more intelligent system such that the spectrum modification method is only applied to an appropriate speech frame.

(Embodiment 2)

Figure 9:
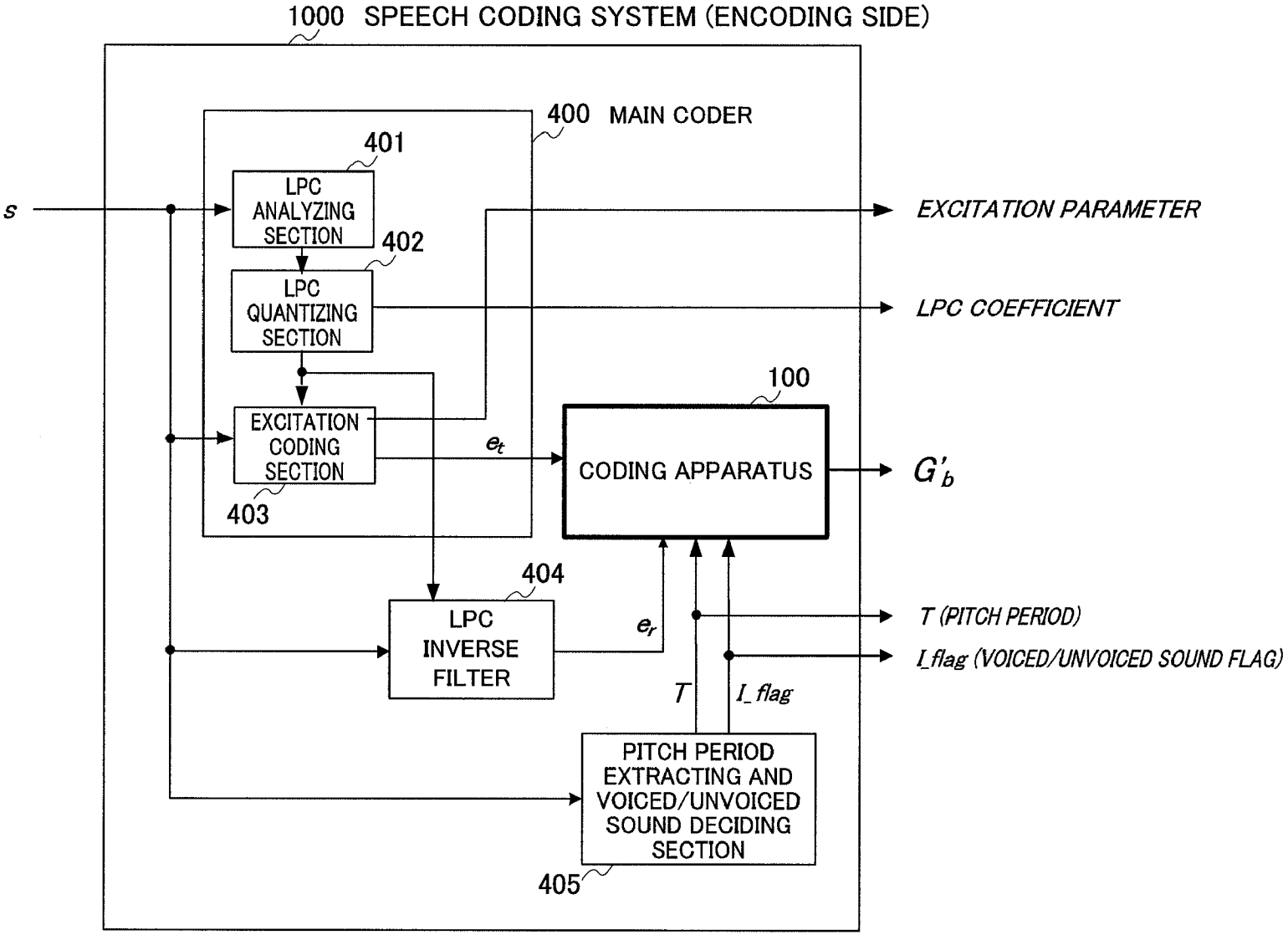
FIG. 9 shows the speech coding system (encoder side) according to Embodiment 2.

FIG. 9 shows an example where coding apparatus 100 according to of Embodiment 1 is applied to typical speech coding system (encoding side) 1000.

LPC analyzing section 401 is used to filter input speech signal s to obtain the LPC coefficient and the excitation signal. The LPC coefficients are quantized and encoded in LPC quantizing section 402 and the excitation signal are encoded in excitation coding section 403 to obtain the excitation parameters. The above components form main coder 400 of a typical speech coder.

Coding apparatus 100 is added to this main coder 400 to improve coding quality. Target signal $e_t$ is obtained from the coded excitation signal from excitation coding section 403. Reference signal $e_r$ is obtained in LPC inverse filter 404 by inverse filtering input speech signal s using the LPC coefficients. Pitch period T and interleave flag I_flag is computed by pitch period extracting and voiced/unvoiced sound deciding section 405 using input speech signal s. Coding apparatus 100 takes these inputs and processes the inputs as described above to obtain scale factor $G'_b$ which is used at the decoding apparatus for the spectrum modification processing.

Figure 10:
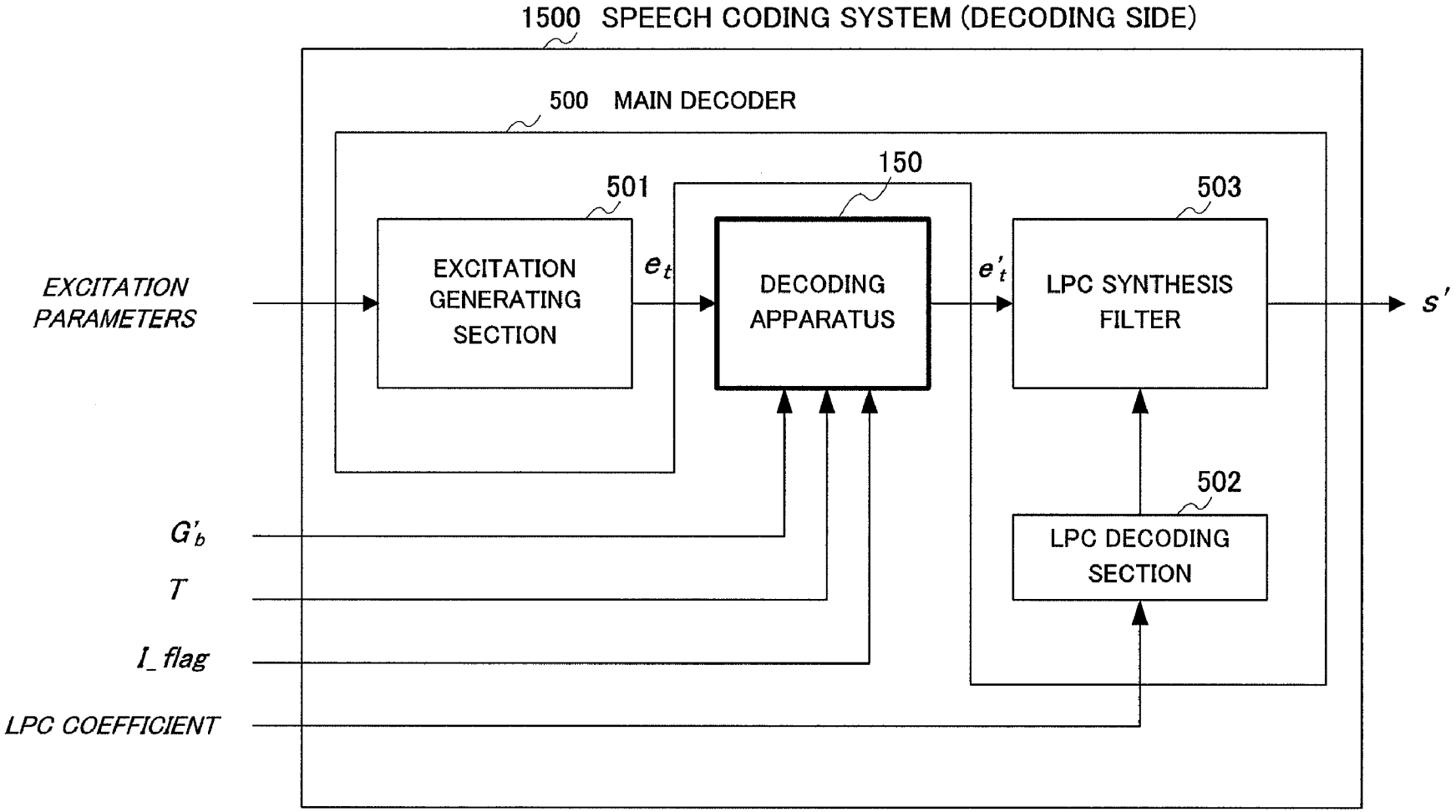
FIG. 10 shows the speech coding system (decoder side) according to Embodiment 2.

FIG. 10 shows an example where decoding apparatus 150 according to Embodiment 1 is applied to typical speech coding system (decoding side) 1500.

In speech decoding system 1500, excitation generating section 501, LPC decoding section 502 and LPC synthesis filter 503 constitute main decoder 500 which is a typical speech decoding apparatus. The quantized LPC coefficients are decoded in LPC decoding section 502 and The excitation signal is generated in excitation generating section 501 using the transmitted excitation parameters. This excitation signal and the decoded LPC coefficients are not used directly to synthesize the output speech. Prior to this, the generated excitation signal is enhanced by modifying the spectrum in decoding apparatus 150 using the transmitted parameters such as pitch period T, interleave flag I_flag and scale factor $G'_b$ according to the processing described above. The excitation signal generated by excitation generating section 501 serves as target signal $e_t$ which is to be modified. The output from spectrum modifying section 103 of decoding apparatus 150 is excitation signal $e'_t$ whose spectrum is modified such that the spectrum is close to the spectrum of reference signal $e_r$. Modified excitation signal $e'_t$ and the decoded LPC coefficients are then used to synthesize output speech s' in LPC synthesis filter 503.

Figure 11:
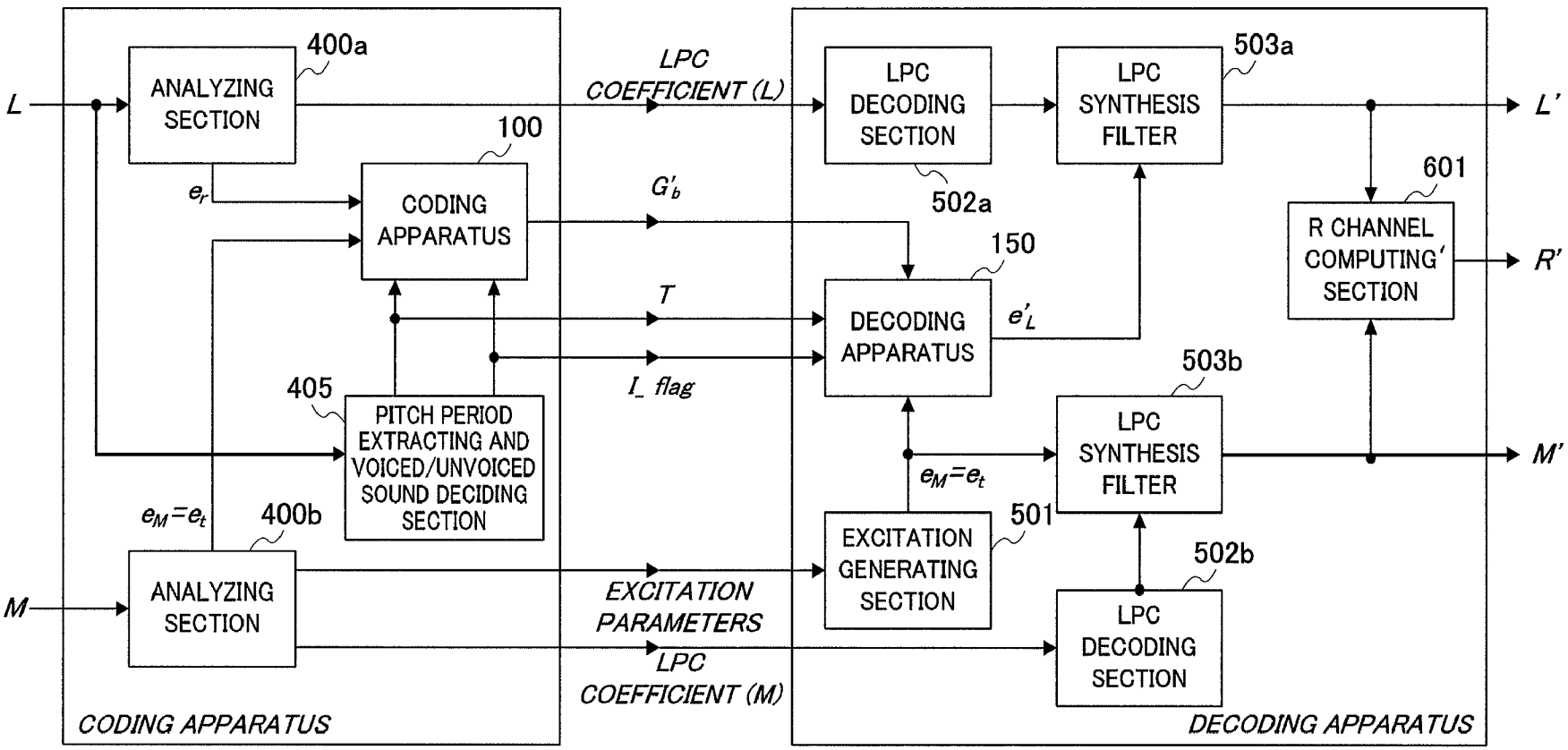
FIG. 11 shows the stereotype speech coding system according to Embodiment 2.

It is evident from the above descriptions that coding apparatus 100 and decoding apparatus 150 according to Embodiment 1 can be applied to a stereo type of speech coding system as shown in FIG. 11. In a stereo speech coding system, the target channel can be the monaural channel. This monaural signal M is synthesized by taking an average of the left channel and the right channel of the stereo channel. The reference channel can be one of the left or right channel. In FIG. 11, left channel signal L is used as the reference channel.

In the coding apparatus, left signal L and monaural signal M are processed in analyzing sections 400*a* and 400*b*, respectively. The processing is the same as the function to obtain the LPC coefficients, excitation parameters and the excitation signal of the respective channels. The left channel excitation signal serves as reference $e_r$ while the monaural excitation signal serves as target signal $e_t$. The rest of the processings at the coding apparatus are the same as described above. The only difference in this application example is that the reference channel sends the set of the LPC coefficients to the decoding apparatus used for synthesizing the reference channel speech signal.

At the decoding apparatus, the monaural excitation signals are generated in excitation generating section 501 and the LPC coefficients are decoded in LPC decoding section 502*b*. Output monaural speech M' is synthesized in LPC synthesis filter 503*b* using the monaural excitation signal and the LPC coefficient of the monaural channel. Furthermore, monaural excitation signal $e_M$ also serves as target signal $e_t$. Target signal $e_t$ is modified in decoding apparatus 150 to obtain estimated or predicted left channel excitation signal $e'_L$. Left channel signal L' is synthesized in LPC synthesis filter 503*a* using modified excitation signal $e'_L$ and the left channel LPC coefficient decoded in LPC decoding 502*a*. After generating left channel signal L' and monaural signal M', right channel signal R' can be derived in R channel computing section 601 using following equation 6.

$$R'=2M'-L' \quad \text{(Equation 6)}$$

In the case of a monaural signal, M is computed by M=(L+R)/2 at the coding side.

In this way, this embodiment improves the accuracy of an excitation signal by applying coding apparatus 100 and decoding apparatus 150 according to Embodiment 1 to the stereo speech coding system. Although the bit rate is slightly increased by introducing the scale factor, a predicted or estimated signal can resemble the original signal to the maximum extent by enhancing the signal so that it is possible to improve the coding efficiency of the speech encoder in terms of "bit rate" vs. "speech quality."

The embodiments of the present invention have been described.

The speech coding apparatus and the spectrum transformation method according to the present invention are not limited to the above embodiments and can be implemented by making various modifications. For example, the embodiments can be implemented by appropriately combining them.

The speech coding apparatus according to the present invention can be provided on communication terminal apparatuses and base station apparatuses in mobile communication systems, so that it is possible to provide communication terminal apparatuses, base station apparatuses and mobile communication systems having same advantages described above.

Also, cases have been described with the above embodiments where the present invention is configured by hardware. However, the present invention can also be realized by software. For example, it is possible to realize similar functions as in the speech coding apparatus according to the present invention by writing an algorithm of the spectrum transformation method according to the present invention in a programming language, storing this program in a memory and executing the program by an information processing section.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-141343, filed on May 13, 2005, the entire content of which is expressly incorporated by reference herein.

Industrial Applicability

The speech coding apparatus and the spectrum transformation method according to the present invention can be applied for use as, for example, a communication terminal apparatus, base station apparatus and the like in a mobile communication system.

The invention claimed is:

1. A speech coding apparatus, comprising:

an acquiring section that acquires a pitch frequency, or an iterative pattern of a frequency spectrum, of a speech signal;

an interleaving section that interleaves a plurality of spectral coefficients for the speech signal, based on the pitch frequency or the iterative pattern, such that similar spectral coefficients are grouped together out of the plurality of spectral coefficients of the frequency spectrum and adaptively adjusts a duration of an interleaving interval for each frame according to the pitch frequency; and a coding section that encodes the interleaved spectral coefficients.

2. The speech coding apparatus according to claim 1, further comprising:

a dividing section that divides the interleaved spectral coefficients into a plurality of bands;

a computing section that computes a ratio of energy of the plurality of bands to energy of a reference signal; and a gain coding section that encodes the energy ratio.

3. The speech coding apparatus according to claim 1, further comprising:

a detecting section that detects an interval in which the pitch frequency is present in the speech signal, wherein the interleaving section performs interleaving processing on the detected interval.

4. A communication terminal apparatus, comprising the speech coding apparatus according to claim 1.

5. A base station apparatus, comprising the speech coding apparatus according to claim 1.

6. The speech coding apparatus according to claim 1, wherein the interleaving section interleaves the plurality of spectral coefficients when a current speech frame is determined to be a periodic and stationary signal, and does not interleave the plurality of spectral coefficients when the current speech frame is determined to be a non-period and non-stationary signal.

7. The speech coding method according to claim 1, further comprising:

a dividing section that divides the plurality of spectral coefficients interleaved by the interleaving section so as to be equal to the interleaving interval or be a multiple of the interleaving interval.

8. The speech coding apparatus according to claim 7, further comprising:

a deciding section that decides a ratio of an energy of a target signal and an energy of a reference signal in each band divided by the dividing section; and a gain section that decides a gain for each rate decided by the deciding section and generates a gain signal combined with each decided gain, wherein the encoding section encodes the gain signal in addition to encoding the spectral coefficients.

9. A spectrum modification method, executed by a speech coding apparatus, comprising:

acquiring, by an acquiring section, a pitch frequency or an iterative pattern of a frequency spectrum of a speech signal;

grouping similar spectral coefficients for the speech signal into a plurality of groups out of a plurality of spectral coefficients of the frequency spectrum, based on the pitch frequency or the iterative pattern; and interleaving, by an interleaving section, the plurality of spectral coefficients for the speech signal, such that the plurality of spectral coefficients are grouped together into the plurality of groups, and adaptively adjusting a duration of the interleaving interval for each frame according to the pitch frequency.

* * * * *